US005551657A

United States Patent [19]

Liethen

[11] Patent Number: 5,551,657

[45] Date of Patent: Sep. 3, 1996

[54] WINDOW ATTACHED MOUNTING BRACKET

[76] Inventor: Frederic J. Liethen, P.O. Box 296, Appleton, Wis. 54912

[21] Appl. No.: 388,288

[22] Filed: Feb. 14, 1995

[51] Int. Cl.[6] ..... A44B 1/18

[52] U.S. Cl. ..... 248/205.2; 24/306

[58] Field of Search ..... 248/205.2, 205.3, 248/205.4, 303, 304, 208, 227; 24/306

[56] References Cited

U.S. PATENT DOCUMENTS

| | | | |
|---|---|---|---|
| 671,900 | 4/1901 | Stanert | 248/304 |
| 3,421,725 | 1/1969 | Glass | 248/304 |
| 3,910,539 | 10/1975 | Cutler | 248/205.3 |
| 4,008,871 | 2/1977 | Rex | 248/205.3 |
| 4,417,710 | 11/1983 | Adair | 248/205.3 |

*Primary Examiner*—Ramon O. Ramirez
*Assistant Examiner*—Willie W. Berry, Jr.
*Attorney, Agent, or Firm*—Andrus, Sceales, Starke & Sawall

[57] ABSTRACT

A mounting bracket assembly is particularly adapted for demountable attachment to the glass pane of a window. The bracket assembly utilizes a hook and loop type fastener and a two piece bracket assembly which permits interchangeable use of different main support arms. One type of support arm may, for example, be used to mount a bird feeder. The hook and loop fastening system provides a reliable replacement for suction cup fasteners which do not function in periods of extended cold temperatures.

6 Claims, 2 Drawing Sheets

WINDOW ATTACHED MOUNTING BRACKET

BACKGROUND OF THE INVENTION

The present invention pertains to a mounting bracket for supporting a bird feeder or the like and, more particularly, to a mounting bracket adapted for demountable attachment directly to a glass window pane.

Mounting brackets for various outdoor applications utilize a wide variety of fastening systems by which they may be demountably or relatively permanently attached to the vertical faces of outside building structures. Such mounting brackets may be, for example, attached directly to the siding surface of a building, to a column or post, to a window casing, or even to the outside surface of a glass window pane. Such brackets typically include a generally horizontally extending support arm attached at one end to a mounting base and having a free end to which the article to be supported by the bracket is attached. The article may comprise, for example, a bird feeder, a flower pot, or any of a wide variety of other items.

When it is desired to attach a mounting bracket directly to a window pane, one type of mounting assembly includes one or more flexible rubber suction cups. The use of a suction cup allows the mounting bracket to be demountably attached to the window. By utilizing a vertical window pane as the sole attachment surface for a mounting bracket, it is unnecessary to apply other types of fasteners, either permanent or demountable, to portions of the window frame or casing or other parts of the structure. Indeed, in some situations the only practical place to attach a window-mounted feeder may be to the surface of the window pane.

However, the use of suction cup mounts presents a serious problem in cold climates. In extremely cold winter weather, rubber suction cups become stiff and hard and will not remain attached to any flat vertical surface, including a window pane, when subjected to any loading, vibration or contact. In short, suction cup mounting brackets simply fall off in periods of extended cold weather. In addition to the unreliability of such mounting assemblies, loss of or damage to the item supported on the bracket is, of course, also a serious concern. However, permanent attachment of another type of mounting bracket may often be a less than satisfactory alternative.

It would be desirable, therefore, to have a mounting bracket which could be reliably secured to the glass surface of a window pane and yet be, to a large extent, demountable and/or replaceable.

SUMMARY OF THE INVENTION

In accordance with the present invention, a demountable mounting bracket especially adapted for mounting on a glass window pane utilizes a hook and loop fastener system permitting all of the assembly, except for one-half of the fastening strip to be demountable. The mounting bracket includes a backing strip which has a rear face adhesively secured to the glass surface and a front face which has secured thereto, adhesively or otherwise, a first layer of a conventional two layer hook and loop type fastening material. A cooperating mounting plate has a rear face to which is secured, adhesively or otherwise, the second layer of the two layer hook and loop fastening material. A support arm is attached at one end to the mounting plate and extends generally horizontally from the vertical window surface. A bearing arm has an upper end attached to the mounting plate and extends vertically downwardly to bearing means on the lower end of the bearing arm. The bearing means engage the vertical surface when the mounting plate is secured to the backing strip to provide load bearing contact to counter and help distribute a load attached to the free end of the support arm.

In the preferred embodiment, the support arm is demountably attached to the mounting plate and the bearing arm is fixed to the mounting plate. In another embodiment, the support and bearing arm may comprise a unitary L-shaped piece fixed to the mounting plate.

In the preferred embodiment, the first and second hook and loop fastening material layers each comprises a pair of horizontally spaced layer portions which, when the layers are brought together in the fastened position, define with the backing strip and the mounting plate a slot for receipt of the upper end of the bearing arm for attachment to the mounting plate. Preferably, the attachment end of the support arm includes a vertically extending portion which is adapted to be demountably attached to the upper end of the bearing arm and to the mounting plate and to be captured in the slot.

DETAILED DESCRIPTION OF THE PREFERRED EMBODIMENTS

Figure 1:
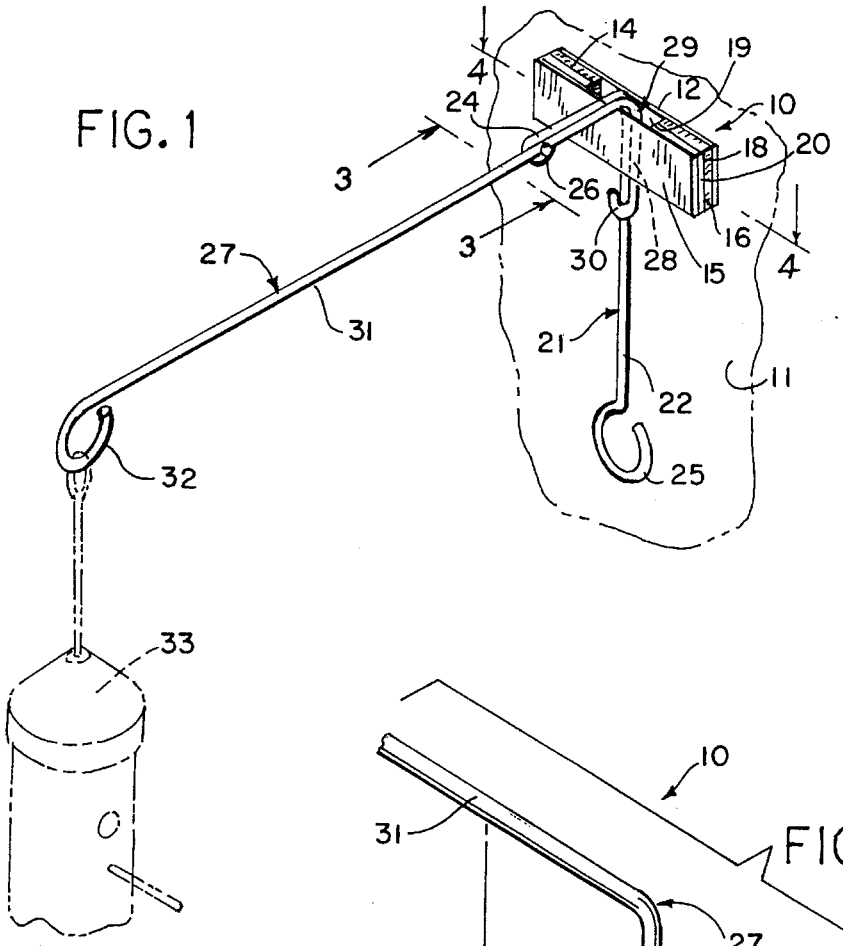
FIG. 1 is a perspective view of the preferred embodiment of the mounting bracket of the subject invention shown attached to the surface of a window pane and supporting a conventional bird feeder.

Referring to FIGS. 1–4, the mounting bracket assembly 10 of the present invention is particularly adapted for demountable attachment to a flat vertical surface, particularly the surface of a glass window pane 11. The assembly includes a backing strip 12 which is secured directly and relatively permanently to the window pane 11 with a suitable adhesive layer 13. The front or outside face of the backing strip 12 has secured thereto one layer 14 of a conventional two layer hook and loop type fastening material such as, for example, the type sold under the well known trademark VELCRO. A similar more recently developed fastening system which may be used is sold under the trademark DUAL LOCK. A rigid mounting plate 15, having a size and shape approximately the same as the backing strip 12, has the second layer 16 of the two layer fastening material attached to its rear face 17.

Each of the fastening material layers 14 and 16 is divided into respective first layer portions 18 and second layer portions 20 which, for each layer, are spaced laterally or horizontally from one another. When the first and second material layers 14 and 16 are brought into fastening contact by pressing the mounting plate 15 against the backing strip 12, the spaced layer portions 18 and 20, along with the front face 19 of the backing strip and the rear face 17 of the mounting plate, define a slot for receipt of and mounting attachment of other components of the bracket assembly to be described.

A bearing arm 21 having the general shape of an inverted L includes a vertical leg 22 secured to the rear face 17 of the mounting plate 15, as with welds 23, and an integral horizontal leg 24 which extends outwardly over the upper edge of the mounting plate 15. The lower end of the vertical leg 22 of the bearing arm is bent into a loop 25 and the outer end of the horizontal leg 24 is bent to form a small upwardly opening cradle 26.

A support arm 27 is also of generally L-shaped construction and includes a short vertical leg 28 on the end of which is formed a rearwardly opening cradle 30 and a long horizontal leg 31 on the end of which is formed a hook-like loop 32. This support arm 27 is formed to cooperatively engage the bearing arm 21 and the mounting plate 15 so that the support arm is initially attached thereto. This loose preliminary attachment is then secured by attaching the mounting plate 15 to the backing strip 12 via the fastening layers 14 and 16 to capture the support arm in the slot 29.

Figure 2:
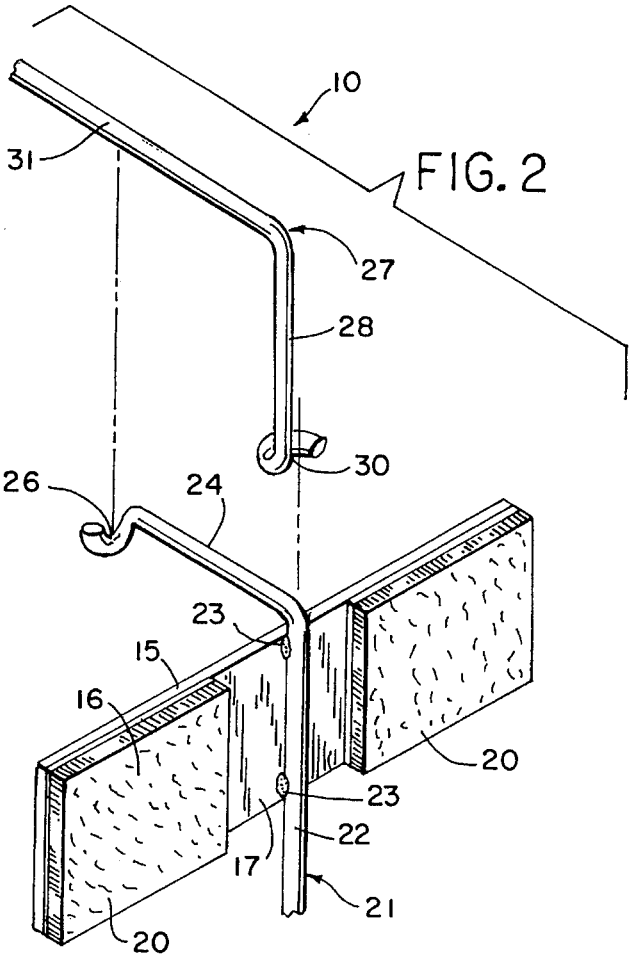
FIG. 2 is an enlarged and exploded perspective view showing the positional relationship between elements of the mounting bracket assembly.
Figure 3:
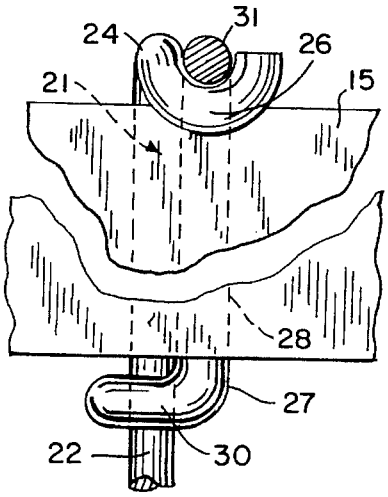
FIG. 3 is an enlarged front elevation of a portion of the bracket taken on line 3—3 of FIG. 1.
Figure 4:
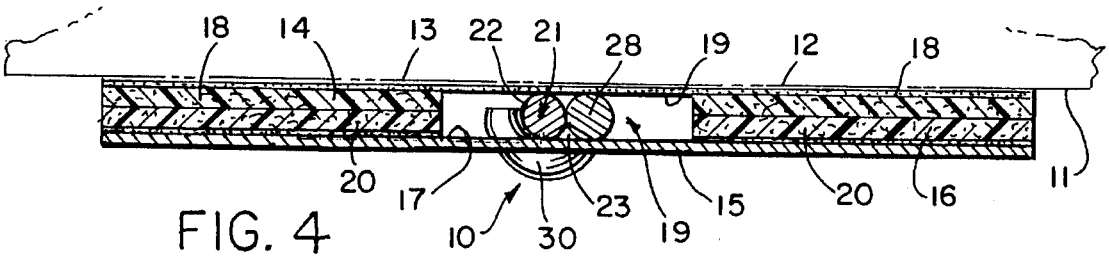
FIG. 4 an enlarged horizontal sectional view taken on line 4—4 of FIG. 1.

The manner in which initial attachment and final securing of the support arm 27 to the bearing arm 21 and mounting plate 15 will now be described in greater detail with particular reference to FIGS. 2–4. The short vertical leg 28 of the support arm 27 is placed behind the rear face 17 of the mounting plate 15 by initially causing the rearwardly opening cradle 30 to engage the vertical leg 22 of the bearing arm 21, just below the lower edge of the mounting plate, and then bringing the horizontal leg 31 of the support arm down into side-by-side parallel relation to the horizontal leg 24 of the bearing arm, thereby supporting leg 31 in the upwardly opening cradle 26 at the end of leg 24. In this position, the vertical leg 28 of the support arm and the upper portion of the vertical leg 22 of the bearing arm are also in parallel side-by-side relation against the rear face 17 of the mounting plate.

The bearing arm 21 and the support arm 27 are preferably made of steel rod material having a diameter, for example, of 3/16th inch (about 5 mm). The mounting plate 15 is also made from sheet steel to accommodate the welds 23, and provide the necessary rigidity. The mounting plate 15 and arms 21 and 27 may also be made of plastic, so long as they are appropriately sized and shaped to provide the necessary strength. The thickness of the rod material from which the arms 21 and 27 are made is also selected with consideration to the thickness of the hook and loop fastening material layers 14 and 16 so that, in the final mounting position (best seen in FIG. 4), the vertical leg 28 of the support arm 27 is captured in its initial attachment position and secured between the mounting plate and the backing strip 12 against the window pane 11. In this final secured position, the vertical leg 22 of the bearing arm, including the bearing loop 25 at the lower end, also lies against the face of the window pane 11.

When the support arm 27 is loaded, as by hanging a bird feeder 33 from the hook-like loop 32 at the end of the arm, the moment created by the vertical load is resisted by bearing contact of the vertical leg 22 and integral loop 25 on the window. In addition to helping dissipate the bearing load on the window, the loop 25 also provides stability against side sway resulting, for example, from wind load. Similarly, the upwardly opening cradle 26 in the horizontal leg of the bearing arm and the rearwardly opening cradle 30 in the vertical leg of the support arm act to transfer the vertical load at the end of the support arm to the bearing arm and mounting plate. The hook and loop fastening layers, of course, must also be adequate to support the load, both in horizontal tension and vertical shear. Fastening layers having a fastening contact surface totaling about 3 square inches has been found to be adequate. It is important not to use too great a contact area of hook and loop fastening material because the rigid mounting surfaces of the window pane 11 and the steel mounting plate 15 require removal of the latter from the former by a prying action rather than a peeling action which is typically used with these fastening systems.

Figure 5:
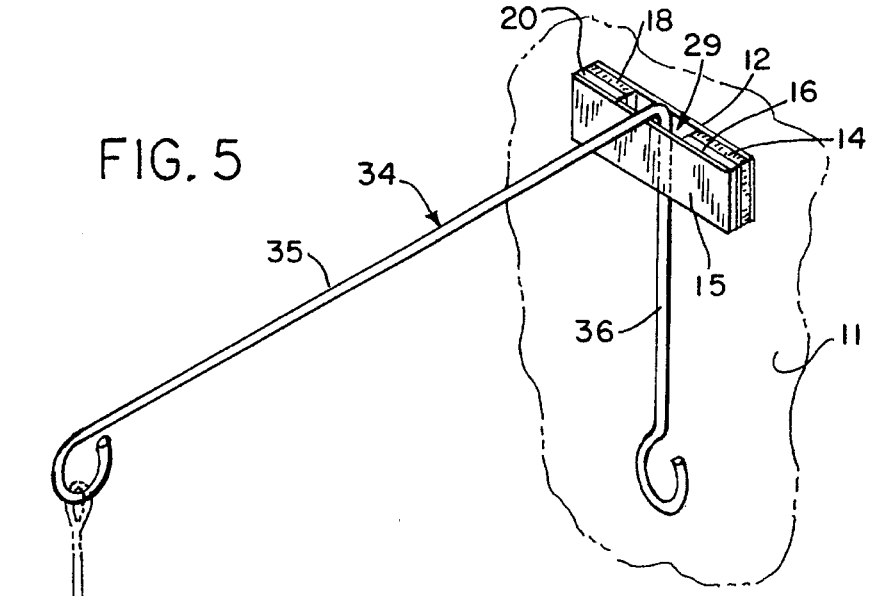
FIG. 5 is a perspective view, similar to FIG. 1, showing an alternate embodiment of the subject invention.

The use of an independently demountable support arm 27 is not necessary, but is convenient for a number of reasons. First of all, it allows the use of a different type of support arm in place of the arm 27 used to support the bird feeder 33 without replacing the rest of the bracket assembly components. The separately demountable support arm also allows the mounting bracket assembly, comprising the backing strip 12, the integrally attached bearing arm 21 and mounting plate 25, and the support arm 27 to be packaged in a much shallower carton than would be required with a unitary construction (as shown in FIG. 5). In other words, by utilizing a three-piece assembly (including the backing strip 12), the maximum depth of the shipping carton need only be equal to the length of the horizontal leg 24 of the bearing arm 21, whereas with a unitary construction of the bearing arm and support arm attached to the mounting plate, a shipping carton would require a depth equal to the horizontal length of the mounting plate.

The unitary construction shown in FIG. 5 otherwise functionally supports an article, such as the bird feeder 33, in the same manner as the preferred embodiment and transmits the load through the mounting plate and fastening system to the bearing arm. Thus, in the FIG. 5 construction, a unitary bracket 34 includes an integral horizontal support arm 35 and bearing arm 36, the latter welded at its upper end to a mounting plate 15 and may be identical to the preferred embodiment. The fastening layers 14 and 16, and the backing strip 12 may also be identical to those utilized in the previously described embodiment.

Figure 6:
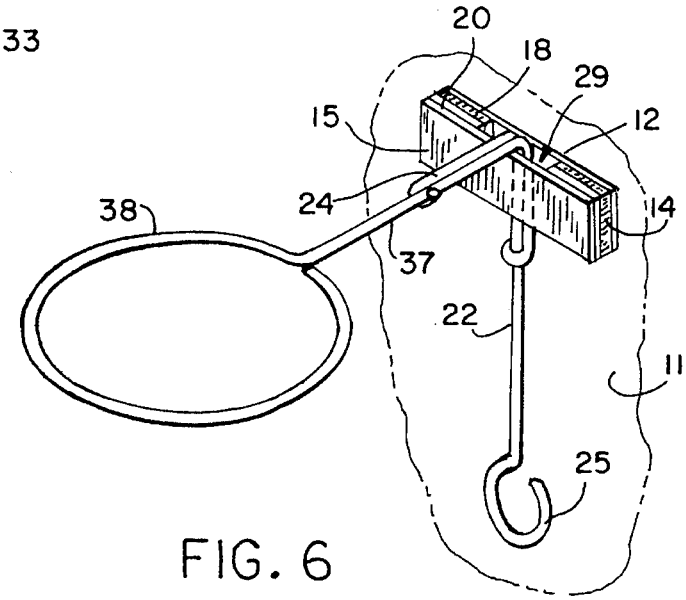
FIG. 6 is a perspective view, similar to FIG. 1, showing an alternate configuration of the demountable support arm.

The embodiment shown in FIG. 6 is in all respects identical to that shown in FIG. 1, except the support arm 37 includes a large loop 38 at its free end. The loop 38 is disposed in a horizontal plane and adapted to receive and support a flower pot (not shown) or the like. Obviously, a support arm with any of a large variety of support end configurations could be utilized. Again, by utilizing the separate demountable support arm constructions, such as shown in FIGS. 1 and 6, the support may be readily replaced while retaining the use of the remaining components of the mounting bracket assembly.

I claim:

1. A mounting bracket for demountable attachment to a flat vertical surface comprising:

a backing strip having a rear face adapted to be adhesively secured to the surface and a front face having secured thereto a first layer of a two layer hook and loop type fastening material;

a mounting plate having a rear face to which is secured a second layer of said two layer hook and loop material;

a support arm operatively joined at one end to said mounting plate and extending generally horizontally from the surface; and, a bearing arm having an upper end attached to said mounting plate and extending vertically downwardly to a lower end below the mounting plate, said bearing arm having bearing means on said lower end for engaging the vertical surface when said mounting plate is secured to said backing strip with said fastening material layers.

2. The invention as set forth in claim 1 wherein said support arm is demountably joined to said mounting plate.

3. The invention as set forth in claim 1 wherein said bearing arm is fixed to said mounting plate.

4. The invention as set forth in claim 1 wherein said first and second fastening material layers each comprise a pair of spaced layer portions which, in the fastened position, define with said backing strip and said mounting plate a slot for receipt of the upper end of said bearing arm for attachment to said plate.

5. The invention as set forth in claim 4 wherein said one end of said support arm includes a vertically extending portion adapted to be demountably attached to the upper end of said bearing arm and said mounting plate and captured in said slot.

6. The invention as set forth in claim 1 wherein said support arm and said bearing arm comprise a unitary generally L-shaped piece.

* * * * *